US011114005B2

(12) United States Patent
Dong et al.

(10) Patent No.: US 11,114,005 B2
(45) Date of Patent: Sep. 7, 2021

(54) PIXEL STRUCTURE AND METHOD FOR DRIVING THE SAME, DISPLAY PANEL AND DISPLAY APPARATUS

(71) Applicant: BOE Technology Group Co., Ltd., Beijing (CN)

(72) Inventors: Tian Dong, Beijing (CN); Li Wang, Beijing (CN); Qian Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/623,989

(22) PCT Filed: Jul. 23, 2019

(86) PCT No.: PCT/CN2019/097257
§ 371 (c)(1),
(2) Date: Dec. 18, 2019

(87) PCT Pub. No.: WO2020/020141
PCT Pub. Date: Jan. 30, 2020

(65) Prior Publication Data

US 2020/0380903 A1 Dec. 3, 2020

(30) Foreign Application Priority Data

Jul. 24, 2018 (CN) ..... 201821177398.6

(51) Int. Cl.
*G09G 3/20* (2006.01)

(52) U.S. Cl.
CPC ..... *G09G 3/20* (2013.01); *G09G 2300/0439* (2013.01); *G09G 2300/0809* (2013.01); *G09G 2310/0297* (2013.01)

(58) Field of Classification Search
CPC ..... G09G 3/20; G09G 2300/0439; G09G 2300/0809; G09G 2310/0297;
(Continued)

(56) References Cited

U.S. PATENT DOCUMENTS 8,654,054 B2 * 2/2014 Lee ..... G09G 3/3648 345/95
8,681,090 B2 * 3/2014 Miyashita ..... G02F 1/167 345/107
(Continued)

FOREIGN PATENT DOCUMENTS

CN 101364021 A 2/2009
CN 101446724 A 6/2009
(Continued)

*Primary Examiner* — Mihir K Rayan
(74) *Attorney, Agent, or Firm* — Westman, Champlin & Koehler, P.A.

(57) ABSTRACT

A pixel structure is disclosed. The pixel structure includes: a plurality of scanning lines; a plurality of data lines intersecting the plurality of scanning lines; and a plurality of sub-pixels which are located at respective intersections of the plurality of scanning lines and the plurality of data lines and are arranged in rows and columns. $(4n+1)^{th}$ and $(4n+2)^{th}$ data lines of the plurality of data lines are located on opposite sides of a $(2n+1)^{th}$ column of sub-pixels respectively. $(4n+3)^{th}$ and $(4n+4)^{th}$ data lines of the plurality of data lines are located on opposite sides of a $(2n+2)^{th}$ column of sub-pixels respectively. The $(4n+2)^{th}$ and $(4n+3)^{th}$ data lines of the plurality of data lines are located between the $(2n+1)^{th}$ column of sub-pixels and the $(2n+2)^{th}$ column of sub-pixels, where n is an integer greater than or equal to 0.

10 Claims, 7 Drawing Sheets

(58) Field of Classification Search
CPC ..... G09G 3/3225; G09G 3/3233; G09G 2300/00; G09G 2300/0426; G09G 2310/067
See application file for complete search history.

(56) References Cited

U.S. PATENT DOCUMENTS

| | | | | |
|---|---|---|---|---|
| 2006/0103323 | A1* | 5/2006 | Eom | G09G 3/3233 315/169.3 |
| 2006/0164352 | A1* | 7/2006 | Yoo | G02F 1/134309 345/87 |
| 2007/0057877 | A1* | 3/2007 | Choi | G09G 3/3291 345/76 |
| 2009/0189881 | A1* | 7/2009 | Ooishi | G09G 3/3688 345/211 |
| 2014/0333688 | A1 | 11/2014 | Hung et al. | |
| 2017/0069271 | A1* | 3/2017 | Kim | G09G 3/3233 |
| 2017/0076665 | A1* | 3/2017 | Kim | G09G 3/3275 |
| 2017/0141177 | A1* | 5/2017 | Kim | G09G 3/3258 |
| 2019/0005905 | A1 | 1/2019 | Chen | |
| 2019/0164502 | A1* | 5/2019 | Yoon | H01L 27/3216 |

FOREIGN PATENT DOCUMENTS

| | | | |
|---|---|---|---|
| CN | 106094306 | A | 11/2016 |
| CN | 107068101 | A | 8/2017 |
| CN | 208521584 | U | 2/2019 |

* cited by examiner

PIXEL STRUCTURE AND METHOD FOR DRIVING THE SAME, DISPLAY PANEL AND DISPLAY APPARATUS

CROSS-REFERENCE TO RELATED APPLICATION(S)

This application is a Section 371 National Stage application of International Application No. PCT/CN2019/097257, filed on Jul. 23, 2019, which has not yet published, and claims priority to the Chinese Patent Application No. 201821177398.6, filed on Jul. 24, 2018, the contents of which are incorporated herein by reference in their entireties.

TECHNICAL FIELD

The present disclosure relates to the field of display technology, and more particularly, to a pixel structure and a method for driving the same, a display panel, and a display apparatus.

BACKGROUND

In order to meet requirements for visual quality in certain use scenarios (for example, virtual reality or mobile games), display apparatuses are desired to have a high refresh rate. However, when the refresh rate is increased to 90 Hz or even 120 Hz, conventional pixel driving methods easily lead to poor display. This may be, for example, due to insufficient compensation for a threshold voltage of a driving transistor in a case of Organic Light-emitting Diode (OLED) pixels or a low pixel charging rate in a case of Liquid Crystal Display (LCD) pixels.

SUMMARY

According to some embodiments of the present disclosure, there is provided a pixel structure, comprising: a plurality of scanning lines; a plurality of data lines intersecting the plurality of scanning lines; and a plurality of sub-pixels which are located at respective intersections of the plurality of scanning lines and the plurality of data lines and are arranged in rows and columns. $(4n+1)^{th}$ and $(4n+2)^{th}$ data lines of the plurality of data lines are located on opposite sides of a $(2n+1)^{th}$ column of sub-pixels respectively. $(4n+3)^{th}$ and $(4n+4)^{th}$ data lines of the plurality of data lines are located on opposite sides of a $(2n+2)^{th}$ column of sub-pixels respectively. The $(4n+2)^{th}$ and $(4n+3)^{th}$ data lines of the plurality of data lines are located between the $(2n+1)^{th}$ column of sub-pixels and the $(2n+2)^{th}$ column of sub-pixels, where n is an integer greater than or equal to 0. The $(4n+1)^{th}$, $(4n+2)^{th}$, $(4n+3)^{th}$, and $(4n+4)^{th}$ data lines of the plurality of data lines have a configuration selected from a group consisting of: (i) the $(4n+1)^{th}$ data line of the plurality of data lines is connected to odd-numbered rows of sub-pixels in the $(2n+1)^{th}$ column of sub-pixels, the $(4n+2)^{th}$ data line of the plurality of data lines is connected to even-numbered rows of sub-pixels in the $(2n+1)^{th}$ column of sub-pixels, the $(4n+3)^{th}$ data line of the plurality of data lines is connected to even-numbered rows of sub-pixels in the $(2n+2)^{th}$ column of sub-pixels, and the $(4n+4)^{th}$ data line of the plurality of data lines is connected to odd-numbered rows of sub-pixels in the $(2n+2)^{th}$ column of sub-pixels; and (ii) the $(4n+1)^{th}$ data line of the plurality of data lines is connected to the even-numbered rows of sub-pixels in the $(2n+1)^{th}$ column of sub-pixels, the $(4n+2)^{th}$ data line of the plurality of data lines is connected to the odd-numbered rows of sub-pixels in the $(2n+1)^{th}$ column of sub-pixels, the $(4n+3)^{th}$ data line of the plurality of data lines is connected to the odd-numbered rows of sub-pixels in the $(2n+2)^{th}$ column of sub-pixels, and the $(4n+4)^{th}$ data line of the plurality of data lines is connected to the even-numbered rows of sub-pixels in the $(2n+2)^{th}$ column of sub-pixels.

In some embodiments, the $(4n+1)^{th}$ and $(4n+2)^{th}$ data lines of the plurality of data lines are symmetrically located on opposite sides of the $(2n+1)^{th}$ column of sub-pixels, and the $(4n+3)^{th}$ and $(4n+4)^{th}$ data lines of the plurality of data lines are symmetrically located on opposite sides of the $(2n+2)^{th}$ column of sub-pixels.

In some embodiments, a distance between the $(4n+1)^{th}$ data line and the $(4n+2)^{th}$ data line of the plurality of data lines is greater than a threshold distance, and a distance between the $(4n+3)^{th}$ data line and the $(4n+4)^{th}$ data line of the plurality of data lines is greater than the threshold distance.

In some embodiments, the plurality of data lines are disposed in the same layer.

In some embodiments, the pixel structure further comprises: a plurality of power lines each connected to a corresponding column of sub-pixels of the respective columns of sub-pixels. A $(2n+1)^{th}$ power line of the plurality of power lines is located between the $(4n+1)^{th}$ data line and the $(4n+2)^{th}$ data line of the plurality of data lines, and a $(2n+2)^{th}$ power line of the plurality of power lines is located between the $(4n+3)^{th}$ data line and the $(4n+4)^{th}$ data line of the plurality of data lines.

In some embodiments, the plurality of power lines are disposed in the same layer as the plurality of data lines.

In some embodiments, the plurality of data lines are made of the same material.

According to some embodiments of the present disclosure, there is provided a display panel comprising any of the pixel structures described above.

According to some embodiments of the present disclosure, there is provided a display apparatus comprising the display panel described above.

In some embodiments, the display apparatus further comprises: a scanning driver configured to sequentially supply a scanning signal to the plurality of scanning lines; a data driver configured to generate a plurality of analog data signals from a digital image signal; and a demultiplexer configured to receive the plurality of analog data signals from the data driver, supply the analog data signals to the $(4n+1)^{th}$ and $(4n+4)^{th}$ data lines of the plurality of data lines in a first period, and supply the analog data signals to the $(4n+2)^{th}$ and $(4n+3)^{th}$ data lines of the plurality of data lines in a second period different from the first period.

In some embodiments, the demultiplexer comprises a plurality of transistors. $(4n+1)^{th}$, $(4n+2)^{th}$, $(4n+3)^{th}$, and $(4n+4)^{th}$ transistors of the plurality of transistors connect the $(4n+1)^{th}$, $(4n+2)^{th}$, $(4n+3)^{th}$, and $(4n+4)^{th}$ data lines of the plurality of data lines to the data driver respectively. The $(4n+1)^{th}$ and $(4n+2)^{th}$ transistors of the plurality of transistors are connected to the same output terminal of the data driver. The $(4n+3)^{th}$ and $(4n+4)^{th}$ transistors of the plurality of transistors are connected to the same output terminal of the data driver.

In some embodiments, the $(4n+1)^{th}$ and $(4n+4)^{th}$ transistors of the plurality of transistors are configured to be turned on in the first period, and the $(4n+2)^{th}$ and $(4n+3)^{th}$ transistors of the plurality of transistors are configured to be turned on in the second period.

In some embodiments, the display apparatus further comprises: a plurality of light-emitting control lines, wherein each of the light-emitting control lines is connected to a corresponding row of sub-pixels of the respective rows of sub-pixels; and a light-emitting control driver configured to sequentially supply a light-emitting control signal to the plurality of light-emitting control lines, wherein $(2i+1)^{th}$ and $(2i+2)^{th}$ rows of sub-pixels in the respective rows of sub-pixels are supplied with the same light-emitting control signal to be enabled to emit light at the same time, where i is an integer greater than or equal to 0.

According to some embodiments of the present disclosure, there is provided a method for driving any of the pixel structures described above. The pixel structure further comprises a plurality of light-emitting control lines, wherein each of the light-emitting control lines is connected to a corresponding row of sub-pixels of the respective rows of sub-pixels. The method comprises: sequentially supplying, by a light-emitting control driver, a light-emitting control signal to the plurality of light-emitting control lines. $(2i+1)^{th}$ and $(2i+2)^{th}$ rows of sub-pixels in the respective rows of sub-pixels are supplied with the same light-emitting control signal to be enabled to emit light at the same time, where i is an integer greater than or equal to 0.

BRIEF DESCRIPTION OF THE ACCOMPANYING DRAWINGS

The accompanying drawings are used to provide a further understanding of the technical solutions according to the present disclosure, and constitute a part of the specification. The accompanying drawings are used to explain the technical solutions according to the present disclosure together with the embodiments of the present application, and do not constitute a limitation to the technical solutions according to the present disclosure. In the accompanying drawings.

DETAILED DESCRIPTION

Figure 1:
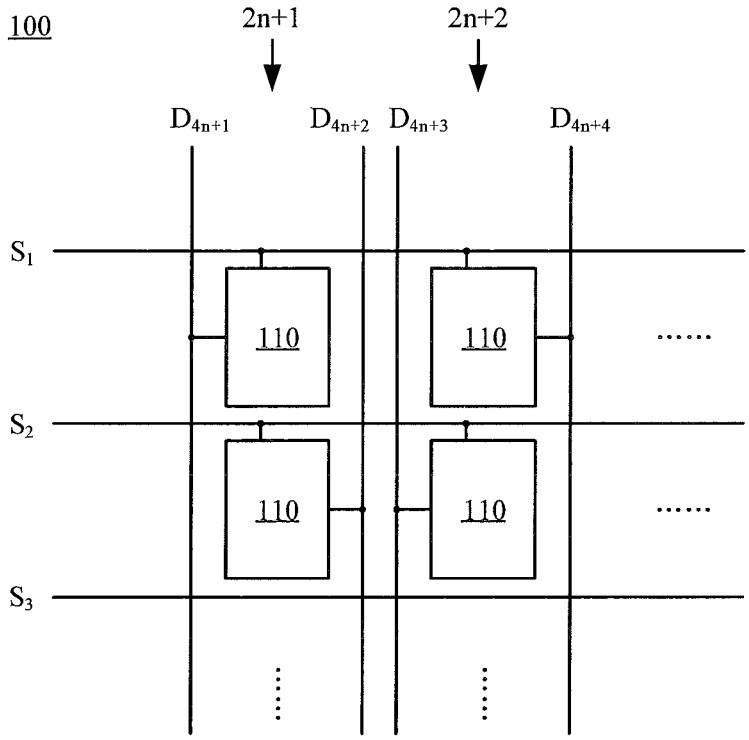
FIG. 1 is an exemplary schematic diagram of a pixel structure according to an embodiment of the present disclosure.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below may be referred to as a second element, component, region, layer or section without departing from the teachings of the present disclosure.

Spatially relative terms such as "row", "column", "below", "under", "lower", "beneath", "on", "upper", etc. may be used herein for convenience of description to describe a relationship between one element or feature and another (some other) element(s) or feature(s) as illustrated in the figures. It will be understood that these spatially relative terms are intended to cover different orientations of a device in use or operation in addition to an orientation depicted in the figures. For example, if the device in the figures is turned over, elements described as "under other elements or features" or "below other elements or features" or "beneath other elements or features" would then be oriented as "on the other elements or features". Thus, the exemplary terms "under" and "beneath" may encompass both orientations "on" and "under". Terms such as "before" or "ahead of" and "after" or "following" may similarly be used, for example, to indicate an order in which light passes through an element. The device may be oriented in other ways (rotated by 90 degrees or at other orientations) and the spatially relative descriptors used herein are interpreted accordingly. In addition, it will also be understood that when a layer is referred to as being "between two layers", it may be the only layer between the two layers, or there may also be one or more intermediate layers between the two layers.

The terms used herein are for the purpose of describing particular embodiments only and are not intended to limit the present disclosure. As used herein, singular forms "a", "an" and "the" are intended to comprise plural forms as well, unless the context clearly indicates otherwise. It will be further understood that terms "including" and/or "comprising" when used in this specification specify the presence of the stated feature, integer, step, operation, element, and/or component, but do not exclude the presence or addition of one or more other features, integers, steps, operations, elements, components, and/or groups thereof. As used herein, the term "and/or" comprises any and all combinations of one or more of the associated listed items.

It will be understood that when an element or layer is referred to as being "on another element or layer", "connected to another element or layer", "coupled to another element or layer", or "adjacent to another element or layer", it may be directly on the other element or layer, directly connected to the other element or layer, directly coupled to the other element or layer, or directly adjacent to the other element or layer, or there may be an intermediate element or layer. In contrast, when an element is referred to as being "directly on another element or layer", "directly connected to another element or layer", "directly coupled to another element or layer", or "directly adjacent to another element or layer", there is no intermediate element or layer. However, in any cases, "on" or "directly on" should not be construed as requiring one layer to completely cover underlying layers.

Unless otherwise defined, all terms (comprising technical and scientific terms) used herein have the same meaning as those commonly understood by those of ordinary skill in the art to which the present disclosure belongs. It will be further understood that terms such as those defined in commonly used dictionaries should be interpreted to have meanings consistent with their meaning in the related art and/or in a context of this specification, and will not be explained in an idealized or excessive formal sense, unless explicitly defined herein.

For the purpose of a high refresh rate, there have been proposed solutions which separately drive odd-numbered rows of sub-pixels and even-numbered rows of sub-pixels. For example, each column of sub-pixels is provided with two data lines which are directly adjacent, wherein one of the data lines is used to supply data signals to the odd-numbered rows of sub-pixels, and the other of the data lines is used to supply data signals to the even-numbered rows of sub-pixels. However, the inventors have realized that the above solutions are prone to cause inaccurate data signals due to the fact that because of coupling capacitance between the two data lines which are directly adjacent, one of the two data lines which are directly adjacent, which is not supplied with a data signal and thus is in a floating state, is susceptible to a data signal on the other of the two data lines which are directly adjacent, and suffers from an undesired induced voltage.

In order to make the purposes, technical solutions, and advantages of the present disclosure more clear, the embodiments of the present disclosure will be described in detail below with reference to the accompanying drawings. It should be illustrated that, various embodiments and features in the embodiments may be combined with each other randomly without a conflict.

FIG. 1 is an exemplary schematic diagram of a pixel structure 100 according to an embodiment of the present disclosure.

As shown in FIG. 1, the pixel structure 100 comprises a plurality of scanning lines (for example, $S_1$, $S_2$ and $S_3$), a plurality of data lines (for example, $D_{4n+1}$, $D_{4n+2}$, $D_{4n+3}$ and $D_{4n+4}$) intersecting the plurality of scanning lines, and a plurality of sub-pixels 110 which are located at respective intersections of the plurality of scanning lines and the plurality of data lines and are arranged in rows and columns.

The sub-pixels 110 may be sub-pixels of an OLED display or other types of organic electroluminescent displays. Alternatively, the sub-pixels 110 may be sub-pixels of a liquid crystal display. In order not to obscure the subject matter of the present disclosure, a specific structure of the sub-pixels 110 is omitted herein.

The $(4n+1)^{th}$ data line $D_{4n+1}$ and the $(4n+2)^{th}$ data line $D_{4n+2}$ are located on opposite sides of a $(2n+1)^{th}$ column of sub-pixels respectively. The $(4n+3)^{th}$ data line $D_{4n+3}$ and the $(4n+4)^{th}$ data line $D_{4n+4}$ are located on opposite sides of a $(2n+2)^{th}$ column of sub-pixels respectively. The $(4n+2)^{th}$ and $(4n+3)^{th}$ data lines are located between the $(2n+1)^{th}$ column of sub-pixels and the $(2n+2)^{th}$ column of sub-pixels, where n is an integer greater than or equal to 0.

In the present embodiment, the $(4n+1)^{th}$ data line $D_{4n+1}$ is connected to odd-numbered rows of sub-pixels in the $(2n+1)^{th}$ column of sub-pixels, the $(4n+2)^{th}$ data line $D_{4n+2}$ is connected to even-numbered rows of sub-pixels in the $(2n+1)^{th}$ column of sub-pixels, the $(4n+3)^{th}$ data line $D_{4n+3}$ is connected to even-numbered rows of sub-pixels in the $(2n+2)^{th}$ column of sub-pixels, and the $(4n+4)^{th}$ data line $D_{4n+4}$ is connected to odd-numbered rows of sub-pixels in the $(2n+2)^{th}$ column of sub-pixels.

As shown in FIG. 1, two data lines connected to the same column of sub-pixels are not directly adjacent to each other. For example, the data lines $D_{4n+1}$ and $D_{4n+2}$ are spaced apart by a certain distance by the $(2n+1)^{th}$ column of sub-pixels. In this way, coupling capacitance between the data lines $D_{4n+1}$ and $D_{4n+2}$ may be reduced. When a data signal is present on the data line $D_{4n+1}$, no undesired induced voltage is induced or a negligible induced voltage is induced on the data line $D_{4n+2}$. Similarly, when a data signal is present on the data line $D_{4n+2}$, no undesired induced voltage is induced or a negligible induced voltage is induced on the data line $D_{4n+1}$. Therefore, the accuracy of the written data signal is improved, and poor display at a high refresh rate is eliminated or alleviated. Although a distance between the data lines $D_{4n+2}$ and $D_{4n+3}$ is small, the two data lines are either supplied with data signals at the same time or are in a floating state at the same time, and therefore may not be significantly affected by the coupling capacitance.

In some embodiments, a distance between the $(4n+1)^{th}$ data line $D_{4n+1}$ and the $(4n+2)^{th}$ data line $D_{4n+2}$ is greater than a threshold distance, and a distance between the $(4n+3)^{th}$ data line $D_{4n+3}$ and the $(4n+4)^{th}$ data line $D_{4n+4}$ is greater than the threshold distance. In this way, it may be ensured that mutual interference between the data lines is reduced. The threshold distance may be determined according to actual needs, which is not limited in the present disclosure.

In some embodiments, the $(4n+1)^{th}$ data line $D_{4n+1}$ and the $(4n+2)^{th}$ data line $D_{4n+2}$ are symmetrically located on opposite sides of the $(2n+1)^{th}$ column of sub-pixels, and the $(4n+3)^{th}$ data line $D_{4n+3}$ and the $(4n+4)^{th}$ data line $D_{4n+4}$ are symmetrically located on opposite sides of the $(2n+2)^{th}$ column of sub-pixels. Specifically, the term "symmetrically located" refers to being symmetrical with respect to a central line of a column of sub-pixels involved.

In some embodiments, the plurality of data lines are disposed in the same layer. In some embodiments, the plurality of data lines are made of the same material (for example, metal). In this way, the manufacturing process is simplified. Further, if metal lines are disposed in the same layer, parasitic capacitance between adjacent data lines may be reduced as compared to a case where the metal lines are disposed in different layers.

In the pixel structure 100, two sub-pixels 110 which are adjacent in a row direction may form one pixel. However, the present disclosure is not limited thereto. For example, one pixel may be composed of three or more sub-pixels.

Figure 2:
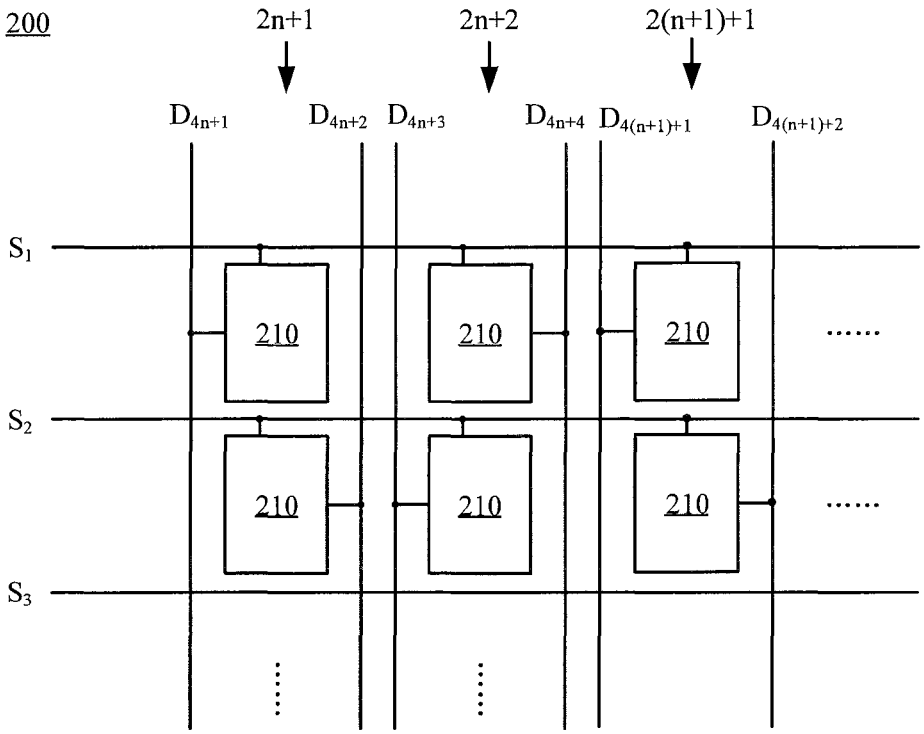
FIG. 2 is an exemplary schematic diagram of a pixel structure according to an embodiment of the present disclosure.

FIG. 2 is an exemplary schematic diagram of a pixel structure 200 according to an embodiment of the present disclosure.

As shown in FIG. 2, the pixel structure 200 comprises a plurality of scanning lines (for example, $S_1$, $S_2$, and $S_3$), a plurality of data lines (for example, $D_{4n+1}$, $D_{4n+2}$, $D_{4n+3}$, $D_{4n+4}$, $D_{4(n+1)+1}$ and $D_{4(n+1)+2}$) intersecting the plurality of scanning lines, and a plurality of sub-pixels 210 which are located at respective intersections of the plurality of scanning lines and the plurality of data lines and are arranged in rows and columns.

The sub-pixels 210 may have the same configuration as that of the sub-pixels 110 of FIG. 1, and will not be repeated here.

The data lines $D_{4n+1}$, $D_{4n+2}$, $D_{4n+3}$ and $D_{4n+4}$ have the same configuration as that in FIG. 1. The data lines $D_{4(n+1)+1}$ and $D_{4(n+1)+2}$ have substantially the same configuration as that of the data lines $D_{4n+1}$ and $D_{4n+2}$, except that the data lines $D_{4(n+1)+1}$ and $D_{4(n+1)+2}$ are located on opposite sides of a $(2(n+1)+1)^{th}$ column of sub-pixels.

In the pixel structure 200, three sub-pixels 210 which are adjacent in a row direction may emit light of different colors (for example, red, green, and blue), and thus form one pixel. The pixel structure 200 has the same advantages as those of the pixel structure 100 and will not be repeated here for the sake of brevity.

Figure 3:
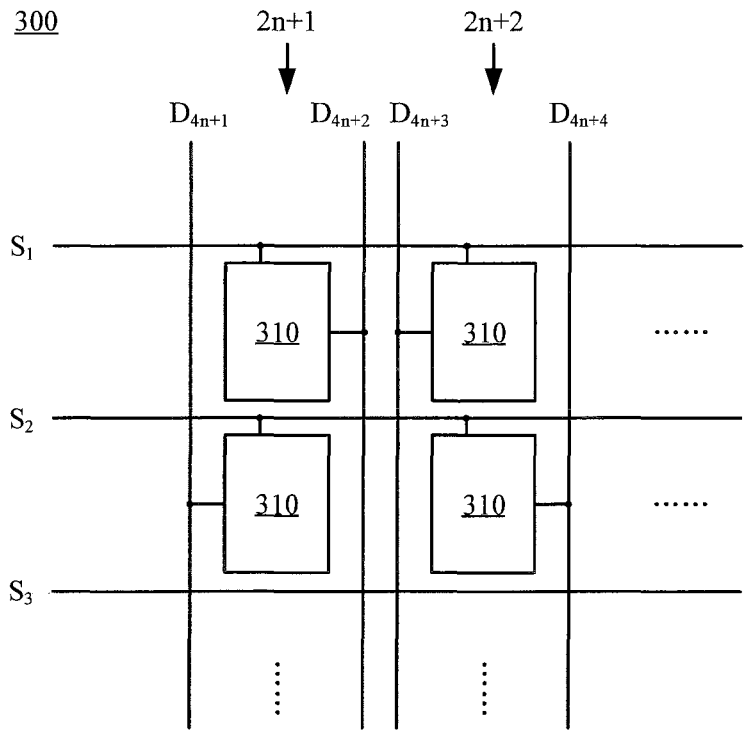
FIG. 3 is an exemplary schematic diagram of a pixel structure according to an embodiment of the present disclosure.

FIG. 3 is an exemplary schematic diagram of a pixel structure 300 according to an embodiment of the present disclosure.

As shown in FIG. 3, the pixel structure 300 comprises a plurality of scanning lines (for example, $S_1$, $S_2$ and $S_3$), a plurality of data lines (for example, $D_{4n+1}$, $D_{4n+2}$, $D_{4n+3}$ and $D_{4n+4}$) intersecting the plurality of scanning lines, and a plurality of sub-pixels 310 which are located at respective intersections of the plurality of scanning lines and the plurality of data lines and are arranged in rows and columns.

The sub-pixels 310 may have the same configuration as that of the sub-pixels 110 of FIG. 1, and will not be repeated here.

The data lines $D_{4n+1}$, $D_{4n+2}$, $D_{4n+3}$ and $D_{4n+4}$ have a different configuration from that in FIG. 1. As shown in FIG. 3, the $(4n+1)^{th}$ data line $D_{4n+1}$ is connected to even-numbered rows of sub-pixels in a $(2n+1)^{th}$ column of sub-pixels, the $(4n+2)^{th}$ data line $D_{4n+2}$ is connected to odd-numbered rows of sub-pixels in the $(2n+1)^{th}$ column of sub-pixels, the $(4n+3)^{th}$ data line $D_{4n+3}$ is connected to odd-numbered rows of sub-pixels in a $(2n+2)^{th}$ column of sub-pixels, and the $(4n+4)^{th}$ data line $D_{4n+4}$ is connected to even-numbered rows of sub-pixels in the $(2n+2)^{th}$ column of sub-pixels.

The pixel structure 300 has the same advantages as those of the pixel structure 100 and will not be repeated here for the sake of brevity.

Figure 4:
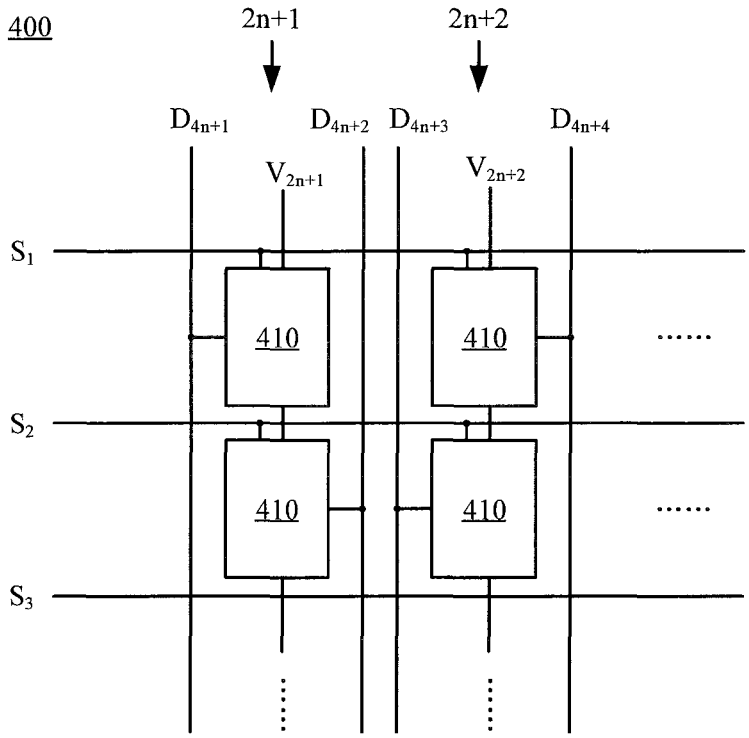
FIG. 4 is an exemplary schematic diagram of a pixel structure according to an embodiment of the present disclosure.

FIG. 4 is an exemplary schematic diagram of a pixel structure 400 according to an embodiment of the present disclosure.

As shown in FIG. 4, the pixel structure 400 comprises a plurality of scanning lines (for example, $S_1$, $S_2$ and $S_3$), a plurality of data lines (for example, $D_{4n+1}$, $D_{4n+2}$, $D_{4n+3}$ and $D_{4n+4}$) intersecting the plurality of scanning lines, and a plurality of sub-pixels 410 which are located at respective intersections of the plurality of scanning lines and the plurality of data lines and are arranged in rows and columns.

The sub-pixels 410 may have the same configuration as that of the sub-pixels 110 of FIG. 1, and will not be repeated here. The data lines $D_{4n+1}$, $D_{4n+2}$, $D_{4n+3}$ and $D_{4n+4}$ have the same configuration as that in FIG. 1 and will not be repeated here.

Unlike the pixel structure 100, the pixel structure 400 further comprises a plurality of power lines (for example, $V_{2n+1}$ and $V_{2n+2}$). Each of the power lines is connected to a corresponding column of sub-pixels of the respective columns of sub-pixels. A $(2n+1)^{th}$ power line $V_{2n+1}$ is located between the $(4n+1)^{th}$ data line $D_{4n+1}$ and the $(4n+2)^{th}$ data line $D_{4n+2}$, and a $(2n+2)^{th}$ power line $V_{2n+2}$ is located between the $(4n+3)^{th}$ data line $D_{4n+3}$ and the $(4n+4)^{th}$ data line $D_{4n+4}$.

In some embodiments, the power lines are disposed on the same layer as the data lines. In this way, additional advantages may be provided, since direct current signals applied on the power lines may suppress a coupling effect between data lines connected to the same column of sub-pixels.

In a case of an organic light-emitting diode display, the pixel structure 400 may further comprise a plurality of light-emitting control scanning lines (not shown), which are used to transmit light-emitting control signals to the sub-pixels 410.

The pixel structure 400 has the same advantages as those of the pixel structure 100 and will not be repeated here for the sake of brevity.

Figure 5:
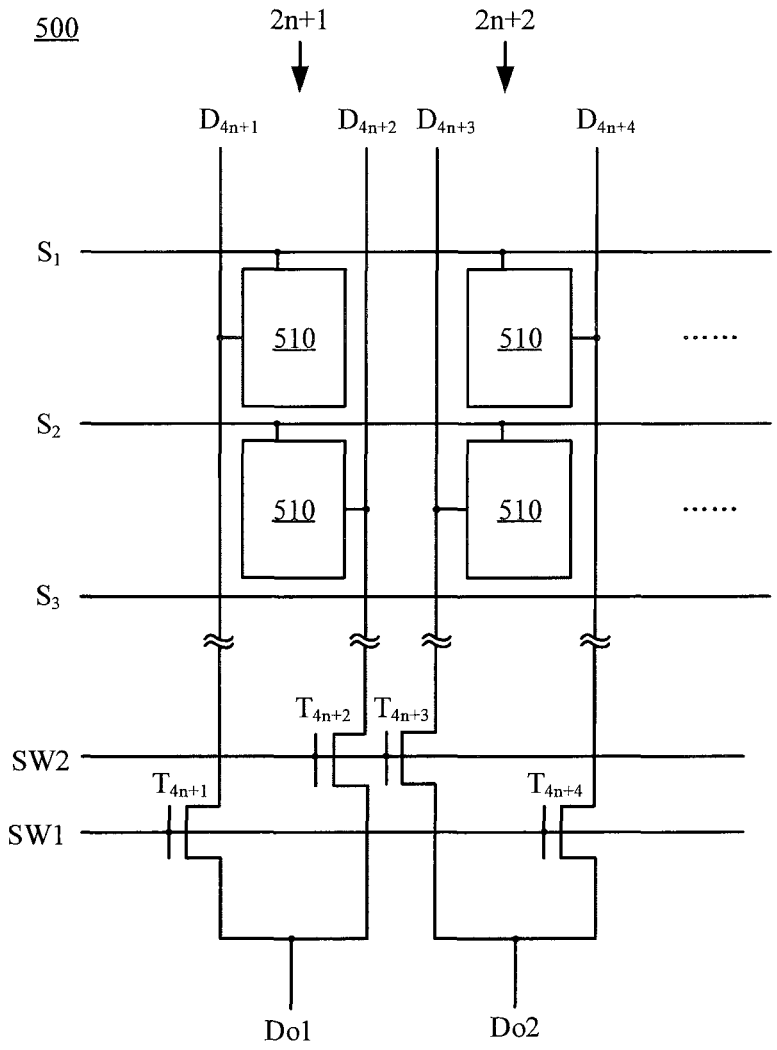
FIG. 5 is an exemplary schematic diagram of a pixel structure according to an embodiment of the present disclosure.

FIG. 5 is an exemplary schematic diagram of a pixel structure 500 according to an embodiment of the present disclosure.

As shown in FIG. 5, the pixel structure 500 comprises a plurality of scanning lines (for example, $S_1$, $S_2$ and $S_3$), a plurality of data lines (for example, $D_{4n+1}$, $D_{4n+2}$, $D_{4n+3}$ and $D_{4n+4}$) intersecting the plurality of scanning lines, and a plurality of sub-pixels 510 which are located at respective intersections of the plurality of scanning lines and the plurality of data lines and are arranged in rows and columns.

The sub-pixels 510 may have the same configuration as that of the sub-pixels 110 of FIG. 1, and will not be repeated here. The data lines $D_{4n+1}$, $D_{4n+2}$, $D_{4n+3}$ and $D_{4n+4}$ have the same configuration as that in FIG. 1 and will not be repeated here.

Unlike the pixel structure 100, the pixel structure 500 further comprises a plurality of transistors (for example, $T_{4n+1}$, $T_{4n+2}$, $T_{4n+3}$ and $T_{4n+4}$). The transistors $T_{4n+1}$, $T_{4n+2}$, $T_{4n+3}$ and $T_{4n+4}$ connect the data lines $D_{4n+1}$, $D_{4n+2}$, $D_{4n+3}$ and $D_{4n+4}$ to a data driver (not shown) respectively. In this example, the transistors $T_{4n+1}$ and $T_{4n+2}$ are connected to the same output terminal Do1 of the data driver, and the transistors $T_{4n+3}$ and $T_{4n+4}$ are connected to the same output terminal Do2 of the data driver. In this way, a number of data driving chips required is reduced, which is beneficial to reducing a frame area of a display panel. The transistors $T_{4n+1}$, $T_{4n+2}$, $T_{4n+3}$ and $T_{4n+4}$ may be manufactured on the same substrate as that of transistors in the sub-pixels 510, although this is not required.

The transistors $T_{4n+1}$ and $T_{4n+4}$ operate in response to a control signal on a first control line SW1, and the transistors $T_{4n+2}$ and $T_{4n+3}$ operate in response to a control signal on a second control line SW2. When the control signal on the first control line SW1 is valid, the transistors $T_{4n+1}$ and $T_{4n+4}$ are turned on and data signals are supplied to the data lines $D_{4n+1}$ and $D_{4n+4}$, so that the odd-numbered rows of sub-pixels 510 emit light. When the control signal on the second control line SW2 is valid, the transistors $T_{4n+2}$ and $T_{4n+3}$ are turned on and data signals are supplied to the data lines $D_{4n+2}$ and $D_{4n+3}$, so that the even-numbered rows of sub-pixels 510 emit light.

The pixel structure 500 has the same advantages as those of the pixel structure 100 and will not be repeated here for the sake of brevity.

Figure 6:
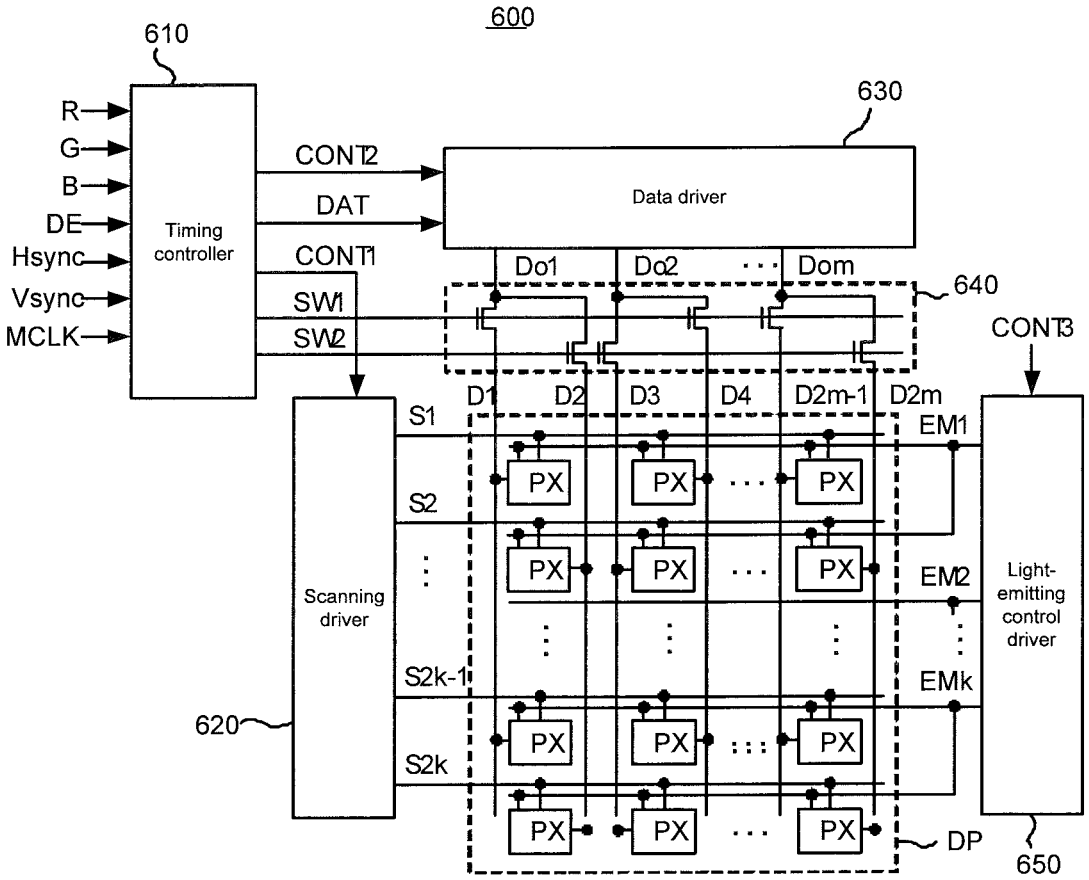
FIG. 6 is an exemplary block diagram of a display apparatus according to an embodiment of the present disclosure.

FIG. 6 is an exemplary block diagram of a display apparatus 600 according to an embodiment of the present disclosure.

As shown in FIG. 6, the display apparatus 600 comprises a timing controller 610, a scanning driver 620, a data driver 630, a demultiplexer 640, a light-emitting control driver 650, and a display panel DP.

The timing controller 610 receives synchronization signals and video signals R, G, and B from a system interface. The synchronization signals may comprise, for example, a horizontal synchronization signal Hsync, a vertical synchronization signal Vsync, a main clock signal MCLK, and a data enabling signal DE. The video signals R, G, and B comprise luminance information of each of a plurality of sub-pixels PX.

The timing controller 610 generates a first driving control signal CONT1, a second driving control signal CONT2, a third driving control signal CONT3, a first switch control signal SW1, a second switch control signal SW2, and a digital image signal DAT according to the video signals R, G, and B, the horizontal synchronization signal Hsync, the vertical synchronization signal Vsync, the data enabling signal DE, and the main clock signal MCLK. The timing controller 610 also divides the video signals R, G, and B in units of frames according to the vertical synchronization signal Vsync, and divides the video signals R, G, and B in units of data lines according to the horizontal synchronization signal Hsync, to generate a digital image signal DAT. The timing controller 610 transmits the digital image signal DAT and the second driving control signal CONT2 to the data driver 630.

The timing controller 610 may be implemented in many ways (for example, using dedicated hardware), to perform various functions discussed herein. A "processor" is an example of the timing controller 610 which uses one or more microprocessors that may be programmed using software (for example, microcodes) to perform the various functions discussed herein. The timing controller 610 may be implemented with or without a processor, and may also be implemented as a combination of dedicated hardware which performs some functions and a processor which performs other functions (for example, one or more programmed microprocessors and associated circuits). Examples of controller components which may be used in various embodiments of the present disclosure comprise, but not limited to, conventional microprocessors, Application Specific Integrated Circuits (ASICs), and Field Programmable Gate Arrays (FPGAs).

The display panel DP comprises any of the pixel structures 100 to 500 described above with reference to FIGS. 1-5. As shown in FIG. 6, the display panel DP comprises sub-pixels PX which are arranged substantially in a matrix form. In the present embodiment, the sub-pixels PX may be OLED pixels, each of which comprises an OLED and associated transistors. In order not to obscure the subject matter of the present disclosure, a specific structure of the sub-pixels PX is not shown in FIG. 6.

In the display panel DP, a plurality of scanning lines S1, S2, S2*k*−1, and S2*k* which are substantially parallel extend in a row direction, a plurality of light-emitting control lines EM1, EM2, . . . , EMk which are substantially parallel extend in the row direction, and a plurality of data lines D1, D2, D3, D4 . . . , D2*m*−1, Dm which are substantially parallel extend in a column direction. The scanning lines S1 to S2*k*, the light-emitting control lines EM1 to EMk, and the data lines D1 to D2*m* are coupled to the sub-pixels PX.

When a light-emitting control signal on a light-emitting control line is valid, a row of sub-pixels PX connected to the light-emitting control line is enabled to emit light. In the present embodiment, a $(2i+1)^{th}$ row of sub-pixels and a $(2i+2)^{th}$ row of sub-pixels are controlled by the same light-emitting control signal, where i is an integer greater than or equal to 0. That is, in operation, the $(2i+1)^{th}$ row of sub-pixels and the $(2i+2)^{th}$ row of sub-pixels are controlled to emit light at the same time. In the example of FIG. 6, first and second rows of sub-pixels PX are connected to the same light-emitting control line EM1 and are driven by the same driver unit (not shown) in the light-emitting control driver 650. Similarly, $(2k-1)^{th}$ and $(2k)^{th}$ rows of sub-pixels PX are connected to the same light-emitting control line EMk and are driven by the same driver unit (not shown) in the light-emitting control driver 650. In this way, a number of driver units required in the light-emitting control driver 650 is reduced, thereby reducing an occupied area of the light-emitting control driver 650.

The scanning driver 620 is coupled to the scanning lines S1 to S2*k*, and generates a plurality of scanning signals according to the first driving control signal CONT1. The scanning driver 620 may sequentially apply a scanning signal to the scanning lines S1 to S2*k*. In some embodiments, the scanning driver 620 may be integrated as a Gate Driver On Array (GOA) with the display panel DP.

The light-emitting control driver 650 is coupled to the light-emitting control lines EM1 to EMk, and generates a plurality of light-emitting control signals according to the third driving control signal CONT3. The light-emitting control driver 650 may sequentially apply a light-emitting control signal to the light-emitting control lines EM1 to EMk. In some embodiments, the light-emitting control driver 650 may be integrated as a GOA with the display panel DP.

The data driver 630 samples and holds the digital image signal DAT according to the second driving control signal CONT2, and generates a plurality of analog data signals from the digital image signal DAT. In some exemplary embodiments, the data driver 630 may comprise a shift register, a latch, a digital-to-analog converter, and a buffer. The shift register may output a latch pulse to the latch. The latch may temporarily store the digital image signal DAT, and may output the digital image signal DAT to the digital-to-analog converter. The digital-to-analog converter may generate analog data signals based on the digital image signal DAT, and output the analog data signals to the buffer. The buffer may output the analog data signals to the demultiplexer 640 through output terminals Do1, Do2, . . . , Dom.

The demultiplexer 640 receives the plurality of analog data signals from the data driver 630. In response to the first switch control signal SW1 being valid in a first period, the demultiplexer 640 supplies the analog data signals to respective ones (for example, the data lines $D_{4n+1}$ and $D_{4n+4}$ in FIG. 5) of the plurality of data lines in the first period, and supplies the analog data signals to respective ones (for example, the data lines $D_{4n+2}$ and $D_{4n+3}$ in FIG. 5) of the plurality of data lines in a second period different from the first period.

In the present embodiment, the demultiplexer 640 comprises a plurality of transistors which have the same configuration as that shown in FIG. 5 and will not be repeated here. In some embodiments, the demultiplexer 640 may be integrated with the display panel DP. As described above, a number of data driving chips required is reduced by using the demultiplexer 640, which thus is beneficial to reducing a frame area of the display panel DP.

By way of example without limitation, the display apparatus 600 may be any product or component having a display function such as a mobile phone, a tablet computer, a television, a display, a notebook computer, a digital photo frame, a navigator, etc.

Figure 7:
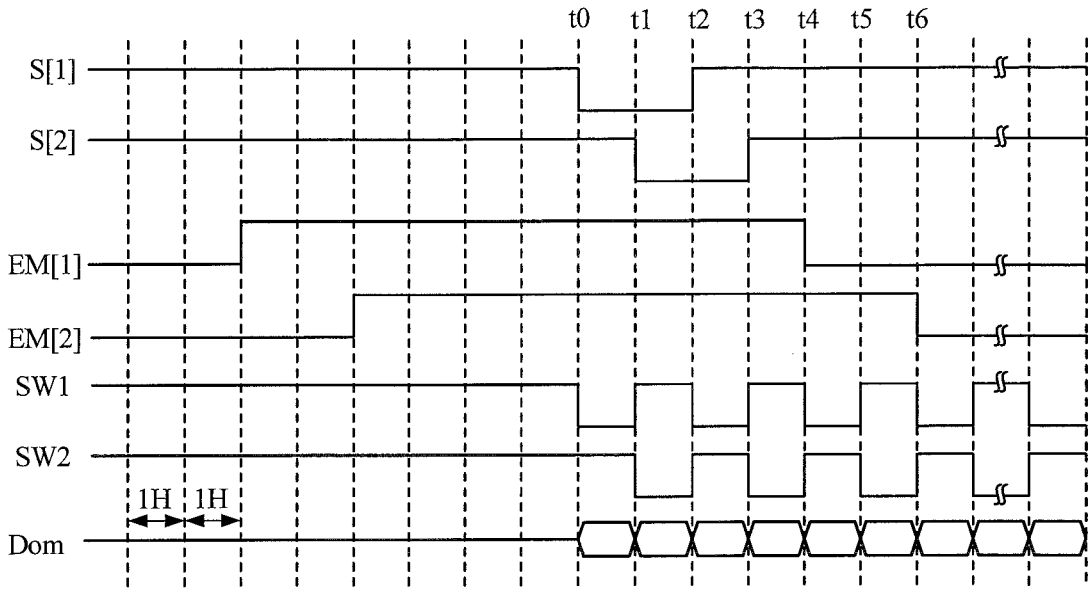
FIG. 7 is an exemplary timing diagram of the display apparatus of FIG. 6.

FIG. 7 is an exemplary timing diagram of the display apparatus 600 of FIG. 6. An operation of the display apparatus 600 will be described below with reference to FIGS. 6 and 7.

As shown in FIG. 7, a scanning signal S[1] on the scanning line S1 and a scanning signal S[2] on the scanning line S2 both have a pulse width of 2H. The scanning signal S[1] is valid (low in this example) in a time period from t0 to t2, and the scanning signal S[2] is valid in a time period from t1 to t3. Therefore, the scanning signals S[1] and S[2] have an overlapping time of 1H. The light-emitting control signal EM[1] becomes valid at time t4, and the light-emitting control signal EM[2] becomes valid at time t6.

In a time period from t0 to t1, the scanning signal S[1] and the first switch control signal SW1 are valid, and the second switch control signal SW2 is invalid (high in this example). A data voltage output by the data driver 630 through the output terminal Dom is transmitted by the demultiplexer 640 to the data line D2*m*−1, and is then written into sub-pixels PX in a first row and an $m^{th}$ column.

In a time period from t1 to t2, the scanning signal S[1] is still valid, the scanning signal S[2] becomes valid, the first switch control signal SW1 becomes invalid, and the second switch control signal SW2 becomes valid. In this case, the data line D2*m*−1 is in a floating state, and a data voltage on the data line D2*m*−1 is maintained by parasitic capacitance on the data line D2*m*−1, and continues to be written into the sub-pixels PX in the first row and the $m^{th}$ column. At the same time, since the scanning signal S[2] and the second switch control signal SW2 are valid, the data voltage output by the data driver 630 through the output terminal Dom is transmitted by the demultiplexer 640 to the data line D2*m*, and is then written into sub-pixels PX in a second row and the $m^{th}$ column.

In a time period from t2 to t3, the scanning signal S[2] is still valid, and the second switch control signal SW2 becomes invalid. In this case, the data line D2*m* is in a floating state, and a data voltage on the data line D2*m* is maintained by parasitic capacitance on the data line D2*m*, and continues to be written into the sub-pixels PX in the second row and the $m^{th}$ column.

In a time period from t3 to t4, corresponding data voltages have been written into the first and second rows of sub-pixels PX. Then, at time t4, the light-emitting control signal EM[1] becomes valid. As described above, since the light-emitting control signal EM[1] is supplied to the first and second rows of sub-pixels PX at the same time, the first and second rows of sub-pixels PX emit light at the same time.

Third to $2k^{th}$ rows of sub-pixels PX operate in a similar manner, and detailed descriptions thereof will be omitted here for the sake of brevity.

By studying the accompanying drawings, the disclosure, and the appended claims, those skilled in the art will be able to understand and implement variations on the embodiments of the present disclosure when practicing the subject matter claimed. In the claims, a word "comprising" does not exclude other elements or steps, and an indefinite article "a" or "an" does not exclude "a plurality of". The mere fact that certain measures are recited in mutually different dependent claims does not indicate that a combination of these measures may not be used to obtain benefits.

We claim:

1. A display apparatus, comprising:

a plurality of scanning lines;

a plurality of data lines intersecting the plurality of scanning lines; and a plurality of sub-pixels which are located at respective intersections of the plurality of scanning lines and the plurality of data lines and are arranged in rows and columns, wherein $(4n+1)^{th}$ and $(4n+2)^{th}$ data lines of the plurality of data lines are located on opposite sides of a $(2n+1)^{th}$ column of sub-pixels respectively, $(4n+3)^{th}$ and $(4n+4)^{th}$ data lines of the plurality of data lines are located on opposite sides of a $(2n+2)^{th}$ column of sub-pixels respectively, the $(4n+2)^{th}$ and $(4n+3)^{th}$ data lines of the plurality of data lines are located between the $(2n+1)^{th}$ column of sub-pixels and the $(2n+2)^{th}$ column of sub-pixels, where n is an integer greater than or equal to 0, and the $(4n+1)^{th}$, $(4n+2)^{th}$, $(4n+3)^{th}$, and $(4n+4)^{th}$ data lines of the plurality of data lines have a configuration selected from a group consisting of:

(i) the $(4n+1)^{th}$ data line of the plurality of data lines is connected to odd-numbered rows of sub-pixels in the $(2n+1)^{th}$ column of sub-pixels, the $(4n+2)^{th}$ data line of the plurality of data lines is connected to even-numbered rows of sub-pixels in the $(2n+1)^{th}$ column of sub-pixels, the $(4n+3)^{th}$ data line of the plurality of data lines is connected to even-numbered rows of sub-pixels in the $(2n+2)^{th}$ column of sub-pixels, and the $(4n+4)^{th}$ data line of the plurality of data lines is connected to odd-numbered rows of sub-pixels in the $(2n+2)^{th}$ column of sub-pixels; and (ii) the $(4n+1)^{th}$ data line of the plurality of data lines is connected to the even-numbered rows of sub-pixels in the $(2n+1)^{th}$ column of sub-pixels, the $(4n+2)^{th}$ data line of the plurality of data lines is connected to the odd-numbered rows of sub-pixels in the $(2n+1)^{th}$ column of sub-pixels, the $(4n+3)^{th}$ data line of the plurality of data lines is connected to the odd-numbered rows of sub-pixels in the $(2n+2)^{th}$ column of sub-pixels, and the $(4n+4)^{th}$ data line of the plurality of data lines is connected to the even-numbered rows of sub-pixels in the $(2n+2)^{th}$ column of sub-pixels;

further comprising:

a scanning driver configured to sequentially supply a scanning signal to the plurality of scanning lines;

a data driver configured to generate a plurality of analog data signals from a digital image signal; and a demultiplexer configured to receive the plurality oi analog data signals from the data driver, supply the analog data signals to the (4n+1)th and (4n+4)th data lines of the plurality of data lines in a first period, and supply the analog data signals to the (4n+2)th and (4n+3)th data lines of the plurality of data lines in a second period different from the first period, wherein the demultiplexer comprises a plurality of transistors, wherein:

(4n+1)th, (4n+2)th, (4n+3)th, and (4n+4)th transistors of the plurality of transistors connect the (4n+1)th, (4n+2)th, (4n+3)th, and (4n+4)th data lines of the plurality of data lines to the data driver respectively, the (4n+1)th and (4n+2)th transistors of the plurality of transistors are connected to the same output terminal of the data driver, and the (4n+3)th and (4n+4)th transistors of the plurality of transistors are connected to the same output terminal of the data driver.

2. The display apparatus according to claim 1, wherein the $(4n+1)^{th}$ and $(4n+2)^{th}$ data lines of the plurality of data lines are symmetrically located on opposite sides of the $(2n+1)^{th}$ column of sub-pixels, and the $(4n+3)^{th}$ and $(4n+4)^{th}$ data lines of the plurality of data lines are symmetrically located on opposite sides of the $(2n+2)^{th}$ column of sub-pixels.

3. The display apparatus according to claim 1, wherein a distance between the $(4n+1)^{th}$ data line and the $(4n+2)^{th}$ data line of the plurality of data lines is greater than a threshold distance, and a distance between the $(4n+3)^{th}$ data line and the $(4n+4)^{th}$ data line of the plurality of data lines is greater than the threshold distance.

4. The display apparatus according to claim 1, wherein the plurality of data lines are disposed in the same layer.

5. The display apparatus according to claim 1, further comprising:

a plurality of power lines each connected to a corresponding column of sub-pixels of the respective columns of sub-pixels, wherein a $(2n+1)^{th}$ power line of the plurality of power lines is located between the $(4n+1)^{th}$ data line and the $(4n+2)^{th}$ data line of the plurality of data lines, and a $(2n+2)^{th}$ power line of the plurality of power lines is located between the $(4n+3)^{th}$ data line and the $(4n+4)^{th}$ data line of the plurality of data lines.

6. The display apparatus according to claim 5, wherein the plurality of power lines are disposed in the same layer as the plurality of data lines.

7. The display apparatus according to claim 1, wherein the plurality of data lines are made of the same material.

8. The display apparatus according to claim 1, wherein the $(4n+1)^{th}$ and $(4n+4)^{th}$ transistors of the plurality of transistors are configured to be turned on in the first period, and the $(4n+2)^{th}$ and $(4n+3)^{th}$ transistors of the plurality of transistors are configured to be turned on in the second period.

9. The display apparatus according to claim 1, further comprising:

a plurality of light-emitting control lines, wherein each of the light-emitting control lines is connected to a corresponding row of sub-pixels of the respective rows of sub-pixels; and a light-emitting control driver configured to sequentially supply a light-emitting control signal to the plurality of light-emitting control lines, wherein $(2i+1)^{th}$ and $(2i+2)^{th}$ rows of sub-pixels in the respective rows of sub-pixels are supplied with the same light-emitting control signal to be enabled to emit light at the same time, where i is an integer greater than or equal to 0.

10. A method for driving the display apparatus according to claim 1, wherein the pixel structure further comprises a plurality of light-emitting control lines, wherein each of the light-emitting control lines is connected to a corresponding row of sub-pixels of the respective rows of sub-pixels, the method comprising:

sequentially supplying, by a light-emitting control driver, a light-emitting control signal to the plurality of light-emitting control lines, wherein $(2i+1)^{th}$ and $(2i+2)^{th}$ rows of sub-pixels in the respective rows of sub-pixels are supplied with the same light-emitting control signal to be enabled to emit light at the same time, where i is an integer greater than or equal to 0.

* * * * *